United States Patent [19]

Jonzon

[11] 4,196,490

[45] Apr. 8, 1980

[54] SPONGE ASSEMBLY

[76] Inventor: Gillis Jonzon, Hallmansvagen 21, 552 59 Jonkoping, Sweden

[21] Appl. No.: 907,705

[22] Filed: May 19, 1978

[30] Foreign Application Priority Data

Jul. 7, 1977 [GB] United Kingdom ..... 28430/77

[51] Int. Cl.[2] ..... A47K 7/03

[52] U.S. Cl. ..... 15/222; 15/244 C; 128/63; 128/65; 401/8; D28/63

[58] Field of Search ..... 15/118, 222, 244 R, 15/244 B, 244 C; 128/62 R, 63, 65; 272/142; 401/8, 7, 201, 268; D7/178; D28/63

[56] References Cited

U.S. PATENT DOCUMENTS

| | | | |
|---|---|---|---|
| 1,473,315 | 11/1923 | Poirier | 15/222 |
| 1,714,687 | 5/1929 | McKeag | 15/222 |
| 2,093,110 | 9/1937 | Meleady | 15/222 |
| 2,133,805 | 10/1938 | Brown | 15/244 B X |
| 2,395,094 | 2/1946 | Booharin | 15/222 X |
| 3,063,081 | 11/1962 | Brown | 15/222 |
| 3,124,822 | 3/1964 | Marchese | 15/244 R X |
| 3,857,133 | 12/1974 | Linenfelser | 15/118 |
| 3,951,404 | 4/1976 | Brown | 272/142 |

FOREIGN PATENT DOCUMENTS

| | | | |
|---|---|---|---|
| 2315883 | 10/1974 | Fed. Rep. of Germany | 15/222 |
| 185 | of 1912 | United Kingdom | 15/222 |
| 1079672 | 8/1967 | United Kingdom | 15/222 |

*Primary Examiner*—Billy J. Wilhite

*Attorney, Agent, or Firm*—Dann, Dorfman, Herrell and Skillman

[57] ABSTRACT

A sponge for personal washing comprising a sponge body having opposite surfaces of different textures and/or compositions. Preferably, the sponge is composed of a thicker part of soft material and a thinner part of coarse-textured material. The thicker part has a through-slot for accommodating an elongated strap having handles at opposite ends. The sponge body is adhered to the strap midway of its ends. The handles are in the form of D-shaped rings made of soft plastic tubing and a dowel connecting the ends of the tubing.

4 Claims, 4 Drawing Figures

SPONGE ASSEMBLY

This invention concerns sponges such as are used for cleaning purposes, for instance personal washing and bathing or for domestic washing and cleansing operations. For convenience, such a sponge will be referred to herein as a "washing sponge."

An object of the present invention is to provide a novel form of assembly including a washing sponge as aforesaid whose utility is considerably improved in comparison with ordinary washing sponges.

With this object in view, the present invention provides a washing sponge assembly characterized in that it comprises a band or strap having a washing sponge connected thereto at a location between the ends of the band or strap.

With such an arrangement, the band or strap facilitates manipulation of the sponge, e.g. for washing areas which are not readily accessible, for example a user's back when bathing. It also enables the sponge to be used, if desired, to be rubbed over desired areas, for example as a frictional massage treatment.

Preferably, the washing sponge is in the form of a body generally of flat slab-like configuration providing two major planar faces at opposite sides of the body, these faces and the plane of the band or strap, where the body is connected thereto, being substantially parallel.

The slab is conveniently generally of rectangular overall shape, with the longitudinal directions thereof and of the band or strap being substantially parallel.

The arrangement is preferably such that the band or strap extends through the washing sponge body. For this purpose, the body may conveniently be provided with a slot passing longitudinally through the body to provide two parts which are positioned opposite sides of the band or strap. These parts extend beyond the side edge of the band or strap.

These parts, which are preferably adhered together to form a composite sponge and the composite sponge is adhered to the band or strap by means of a water-resistant adhesive. The parts may be of similar resilient porous absorbent materials, or may be of different materials. It is also possible for one of the parts to be of laminar form providing an inner layer which is of material similar to that of the other part, for adhering thereto, and an outer layer which is of a material different from that of the other part, so that one may have, for example, one soft side and one rough side on the sponge body.

Handles may, if desired, be provided one on each end of the band or strap. For this purpose, each end of the band or strap may be folded back on itself and secured to form a loop or tunnel for enabling the respective handle to be engaged therein and each such handle may comprise, for example, an endless ring or D of soft plastic tubing or the like. Such a ring or D may be formed by pushing a length of plastic tubing through the respective loop or tunnel so that its ends protrude, forming a joint between the ends of the tubing by pushing them onto a dowel or rod, and then manipulating the resulting D-shaped ring so as to bring the joint into a position within the loop or tunnel, in which it is masked from view and protected against separation.

The invention will be described further, by way of example, with reference to the accompanying drawing, in which.

The illustrated embodiment of the assembly of the invention comprises a band or strap 10, woven for instance of non-absorbent plastic filaments and being broad and relatively strong. At each end, this band or strap is folded back upon itself at 11 to form respective loops or tunnels 12, and each such loop or tunnel 12 serves for the connection to the band or strap 10 of a respective handle 13.

Figure 1:
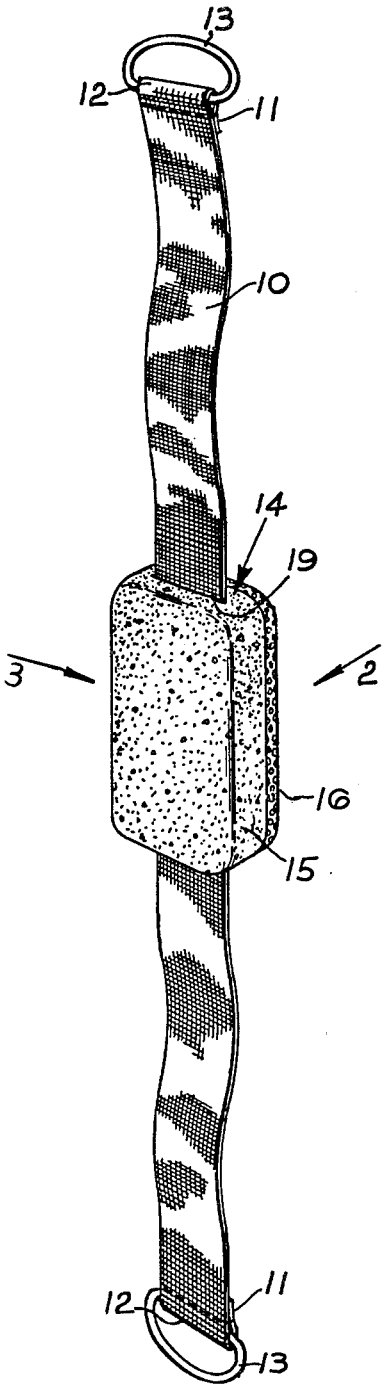
FIG. 1 is a perspective view illustrating a practical embodiment of the sponge assembly of the invention with its band or strap in a slackly-extended condition.
Figure 2:
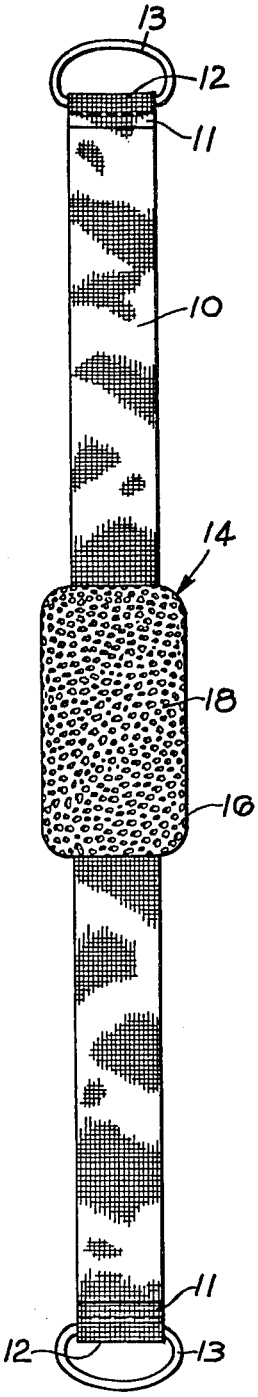
FIG. 2 is an elevation taken as indicated by the arrow 2 in FIG. 1.
Figure 3:
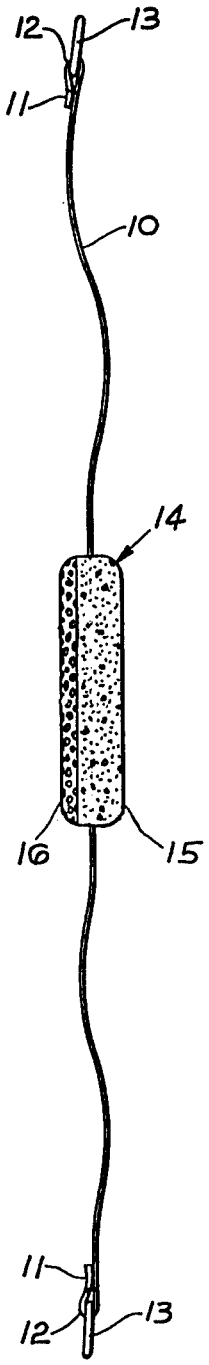
FIG. 3 is an edge view taken as indicated by the arrow 3 in FIG. 1.
Figure 4:
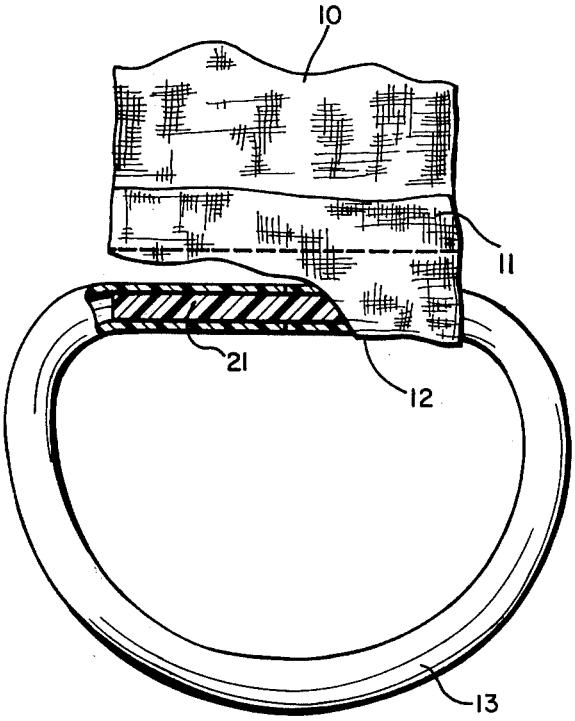
FIG. 4 is an enlarged view of the handle portion with parts broken away to illustrate the construction thereof.

In the illustrated case, each such handle 13 is in the form of a ring or D of soft plastic tubing. This ring or D is formed by inserting a length of the tubing into the respective loop or tunnel 12 so that both ends of it project therefrom; inserting a rod or dowel 21 (see FIG. 4), of length shorter than the width of the band or strap, into one end of the tubing, this rod or dowel being a relatively snug fit in the tubing so that it will not readily slip out of the tubing and being left protruding from the said one end of the tubing; bending the tubing around appropriately and pushing the other end thereof onto the protruding end of the rod or dowel so that the two tubing ends are now joined by the dowel; and finally working the resilient D-shaped ring through the respective loop or tunnel 12 so that the joint between the ends of the tubing is accommodated within and masked by the loop or tunnel 12 which contributes to ensuring that the joined ends of the tubing do not separate.

As will be evident from the figures, connected to the band or strap 10 about midway along its length, is a sponge body which is indicated generally by the reference numeral 14 and which is generally of flat slab-like configuration providing two major planar faces, one at each side of the body 14, which faces are generally parallel to the plane of that part of the band or strap 10 to which the body 14 is connected. This body 14, which is generally of rectangular overall configuration, in the illustrated form with its corners rounded off, and is disposed with its longitudinal direction substantially parallel to the longitudinal direction of the band or strap 10, prior to being applied to the band or strap 10, is composed of two parts of different thickness indicated generally by the reference numerals 15 and 16 in the drawings. The thicker body part 15 is of a relatively soft textured material, for instance sponge rubber or a soft polyurethane, while the thinner body part 16 is composed of a relatively coarser and/or rougher textured material than the part 15, for example a very coarse open-pored polyurethane foam which is relatively less resilient than the material of the body part 15. The parts 15 and 16 are laminated together to form the composite sponge body 14, for example by using a water-resistant adhesive.

To anchor the composite-body 14 to the strap 10, the thicker part 15 is provided with a through-slot 19 which extends midway between the exposed surfaces of the parts 15 and 16, generally parallel thereto.

The strap 10 is passed through the slot 19 and is adhered thereto by using a water-resistant adhesive, this adhesive being applied inside the slot as well as to the band or strap 10, to ensure that these elements are firmly adhered to one another.

An alternate construction entails slitting the part 15 all the way through instead of making a slot therein. The slit portions may then be cemented back together again with the strap 10 between to anchor the sponge body to the strap.

The mode of use of the illustrated device will readily be understood. For ordinary use, e.g. in a bath, the user will, of course, firstly saturate the sponge body 14 with water and apply soap thereto. Then, holding the two handles 13, the user can draw the body 14 back and forth across his back, thereby efficiently washing his back in the same way as can be effected using a back brush. Of course, he can use the device with the soft side or the coarse side to his skin as may be desired. The device can additionally be used on any part of the user's body, with the user drawing the sponge body 14 back and forth over the desired area by means of the band or strap 10, which can be effected at a relatively high speed if appropriate, e.g. for achieving a massaging effect.

The part of the band or strap 10 which extends through the body 14, together with the water-resistant adhesive, tend to impart a certain degree of stiffness to the sponge body 14. In the preferred embodiment, the stiffness is confined to the central portion of the composite body. Accordingly, if the user folds the exposed band or strap parts against one face of the body 14, he can hold the device in his hand with the other face exposed, and use the device in exactly the same way as a conventional sponge.

The invention is not confined to the precise details of the foregoing example and variations may be made thereto. For instance, it will be obvious that it is not essential to provide the handles 13 since the user can draw the band or strap 10 back and forth simply by gripping and pulling on the ends of the band or strap 10. Where handles are provided, they can, of course, be of different form from these described.

I claim:

1. A washing sponge assembly comprising a washing sponge body having at least two parts of respectively soft and rough uniform composition throughout, one part having the soft composition to produce a soft texture on one face and the second part having the rough composition to produce a rough texture on the opposite face, said soft part being substantially thicker than said rough part, said parts being joined together along a junction plane to form a generally flat slab-like rectangular overall configuration providing planar rectangular faces at opposite sides of the body, these faces constituting said soft and rough textured faces respectively, said one part having slot means passing longitudinally through said one part in a plane spaced between said junction plane and the planar rectangular face of said one part, strap means substantially narrower than the width of said rectangular faces and secured in said slot means in a plane substantially parallel to said faces and extending through said body longitudinally of said rectangular faces so that edge portions of said parts extend beyond the corresponding edges of said strap means, said strap means secured to said body at a location between the ends of the strap means, and having handles at the opposite ends thereof.

2. An assembly according to claim 1 wherein said strap means comprises a webbing, each of the ends of said webbing being turned back upon itself and sewn to itself to provide loops, said handles comprising an endless D-shaped ring of soft plastic tubing in each of said loops.

3. An assembly as claimed in claim 2 wherein each said D-shaped ring includes a dowel having a length corresponding to the width of the webbing, and each handle is formed by extending the plastic tubing through the respective loop, the ends of the tubing being joined by said dowel telescopically engaged therein to form the D-shaped ring, the entire dowel and the joint being positioned within the loop.

4. An assembly as claimed in claim 1 wherein said two parts are joined to each other in said junction plane by a waterproof adhesive, and said strap means is anchored in said slot means by a waterproof adhesive to position said sponge body along said strap means midway between said handles, said slot means being equally spaced from the differently-textured opposite faces of said washing sponge body.

* * * * *